US011629604B2

(12) United States Patent
Kwak et al.

(10) Patent No.: US 11,629,604 B2
(45) Date of Patent: Apr. 18, 2023

(54) STRUCTURE FOR ASSEMBLING TURBINE BLADE SEALS, GAS TURBINE INCLUDING THE SAME, AND METHOD OF ASSEMBLING TURBINE BLADE SEALS

(71) Applicant: DOOSAN ENERBILITY CO., LTD, Changwon-si (KR)

(72) Inventors: Joo Hwan Kwak, Changwon (KR); Iurii Goroshchak, Gimhae (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 65 days.

(21) Appl. No.: 17/349,754

(22) Filed: Jun. 16, 2021

(65) Prior Publication Data

US 2022/0056806 A1 Feb. 24, 2022

(30) Foreign Application Priority Data

Aug. 21, 2020 (KR) ..... 10-2020-0105254

(51) Int. Cl.
*F01D 5/32* (2006.01)
*F01D 11/00* (2006.01)
*F01D 5/30* (2006.01)

(52) U.S. Cl.
CPC ..... *F01D 5/32* (2013.01); *F01D 5/3015* (2013.01); *F01D 11/006* (2013.01); *F05D 2220/30* (2013.01); *F05D 2230/60* (2013.01); *F05D 2240/24* (2013.01)

(58) Field of Classification Search
CPC ..... F01D 5/32; F01D 5/3015; F01D 11/006
See application file for complete search history.

(56) References Cited

U.S. PATENT DOCUMENTS 3,572,966 A * 3/1971 Borden ..... F01D 5/081 415/177
8,956,122 B2 2/2015 Helmis
2008/0008593 A1* 1/2008 Zagar ..... F01D 5/3015 416/220 R (Continued)

FOREIGN PATENT DOCUMENTS

EP 1840338 10/2007
EP 1944100 A1 7/2008

(Continued)

OTHER PUBLICATIONS

KR OA dated Nov. 26, 2021.
EESR dated Jan. 19, 2022.

*Primary Examiner* — Richard A Edgar
*Assistant Examiner* — Michael K. Reitz
(74) *Attorney, Agent, or Firm* — Harvest IP Law, LLP

(57) ABSTRACT

A structure for assembling turbine blade seals, a gas turbine including the same, and a method of assembling turbine blade seals are provided. The structure for assembling turbine blade seals includes a turbine blade including an airfoil, a platform, and a root, a turbine rotor disk to which the root of the turbine blade is mounted, a seal plate mounted between the platform and one side of the turbine rotor disk to seal a cooling channel defined within the root and the platform, an insertion pin inserted through the turbine rotor disk and the seal plate to fix the seal plate to the turbine rotor disk, and a retainer configured to fix the insertion pin and to prevent the insertion pin from falling out.

6 Claims, 9 Drawing Sheets

(56) References Cited

U.S. PATENT DOCUMENTS

| | | | | |
|---|---|---|---|---|
| 2008/0181768 | A1 | 7/2008 | Brucher | |
| 2010/0196164 | A1 | 8/2010 | Liotta | |
| 2012/0128504 | A1* | 5/2012 | Ahaus | F01D 5/081 416/97 R |
| 2016/0265378 | A1 | 9/2016 | Dungs | |
| 2016/0293145 | A1* | 10/2016 | Chapman | G10D 3/095 |
| 2022/0243599 | A1* | 8/2022 | Goroshchak | F01D 5/3053 |

FOREIGN PATENT DOCUMENTS

| | | | |
|---|---|---|---|
| EP | 1944471 | A1 | 7/2008 |
| EP | 2218873 | A1 | 8/2010 |
| JP | 1998008906 | A | 1/1998 |
| JP | 2008169838 | A | 7/2008 |
| KR | 1020110136894 | A | 12/2011 |
| KR | 1020200020415 | A | 2/2020 |

* cited by examiner

STRUCTURE FOR ASSEMBLING TURBINE BLADE SEALS, GAS TURBINE INCLUDING THE SAME, AND METHOD OF ASSEMBLING TURBINE BLADE SEALS

CROSS-REFERENCE TO RELATED APPLICATION

This application claims priority to Korean Patent Application No. 10-2020-0105254, filed on Aug. 21, 2020, the disclosure of which is incorporated herein by reference in its entirety.

BACKGROUND

Technical Field

Apparatuses and methods consistent with exemplary embodiments relate to a structure for assembling turbine blade seals, a gas turbine including the same, and a method of assembling turbine blade seals.

Description of the Related Art

Turbines are machines that obtain a rotational force by impingement or reaction force using a flow of a compressible fluid such as steam or gas, and include a steam turbine using steam, a gas turbine using hot combustion gas, and so on.

The gas turbine includes a compressor, a combustor, and turbine. The compressor includes an air inlet into which air is introduced, and a plurality of compressor vanes and a plurality of compressor blades alternately arranged in a compressor casing.

The combustor supplies fuel to air compressed by the compressor and ignites a mixture thereof with a burner to produce high-temperature and high-pressure combustion gas.

The turbine includes a plurality of turbine vanes and a plurality of turbine blades alternately arranged in a turbine casing. In addition, a rotor is disposed to pass through the centers of the compressor, the combustor, the turbine, and an exhaust chamber.

The rotor is rotatably supported at both ends thereof by bearings. The rotor has a plurality of disks fixed thereto, and a plurality of blades are connected to each of the disks. A drive shaft of a generator is connected to an end of the rotor that is adjacent to the exhaust chamber.

The gas turbine is advantageous in that consumption of lubricant is extremely low due to the absence of mutual friction parts such as a piston-cylinder because the gas turbine does not have a reciprocating mechanism such as a piston which is usually provided in a four-stroke engine, an amplitude of vibration, which is a characteristic of reciprocating machines, is greatly reduced, and it enables high-speed motion.

The operation of the gas turbine is briefly described. The air compressed by the compressor is mixed with fuel so that the mixture thereof is burned to produce hot combustion gas, and the produced combustion gas is discharged to the turbine. The discharged combustion gas generates a rotational force while passing through the turbine vanes and turbine blades, thereby rotating the rotor.

A cooling channel for supplying cooling air from each turbine rotor disk to each turbine blade of the turbine rotor disk may be defined within a root of the turbine blade. In order to seal the cooling channel, seal plates may be coupled to the root of the turbine blade and both axial sides of the rotor disk so as to be pressed thereagainst.

In the related art, each of the seal plates is fixedly fastened to the root of the turbine blade by a bolt or the like. However, a head of the bolt protrudes from the seal plate, resulting in a windage loss due to friction with gas during high-speed rotation. In addition, a weight of the bolt generates a large centrifugal force when the bolt is fastened to the root of the turbine blade, which may cause an increase in stress on the root of the turbine blade.

SUMMARY

Aspects of one or more exemplary embodiments provide a structure for assembling turbine blade seals, a gas turbine including the same, and a method of assembling turbine blade seals, which are capable of reducing a windage loss due to gas friction by removing a portion of a fixing member protruding from a seal plate and a turbine rotor disk, wherein the fixing member serves to fix a lower end of the seal plate to the turbine rotor disk, and which are capable of improving structural stability of a turbine blade by minimizing a load applied to a root of the turbine blade.

Additional aspects will be set forth in part in the description which follows and, in part, will become apparent from the description, or may be learned by practice of the exemplary embodiments.

According to an aspect of an exemplary embodiment, there is provided a structure for assembling turbine blade seals including: a turbine blade including an airfoil, a platform, and a root, a turbine rotor disk to which the root of the turbine blade is mounted, a seal plate mounted between the platform and one side of the turbine rotor disk to seal a cooling channel defined within the root and the platform, an insertion pin inserted through the turbine rotor disk and the seal plate to fix the seal plate to the turbine rotor disk, and a retainer configured to fix the insertion pin and to prevent the insertion pin from falling out.

The turbine rotor disk may include a mounting rib extending from one side thereof to form a mounting groove into which a radially inner end of the seal plate is inserted, and a through-hole formed through the mounting rib for insertion of the insertion pin.

The seal plate may include a pinhole formed therethrough at a position corresponding to the through-hole of the mounting rib.

The insertion pin may include a cylindrical body, a head integrally formed at one side of the body and having an outer diameter larger than that of the body, and a cutout formed on a bottom of the body and the head so that the retainer is pressed against the cutout.

The insertion pin may further include a groove formed on the head, the groove being stepped from the cutout while extending thereto, and the retainer being pressed against the groove.

The turbine rotor disk may include a head receiving hole formed on one side of the through-hole and having an inner diameter larger than the through-hole so that the head of the insertion pin is received in the head receiving hole.

The retainer may be formed by bending a rectangular plate and may include a horizontal portion that is bent by plastic deformation, a stepped portion connected from the horizontal portion in a stepped manner, and a vertical portion bent vertically from the stepped portion.

The head of the insertion pin may be supported by a bent portion formed by bending a portion of the horizontal portion after the retainer is inserted into the through-hole of the mounting rib and the insertion pin is inserted into the through-hole.

The bent portion may be disposed inside the head receiving hole.

According to an aspect of another exemplary embodiment, there is provided a gas turbine including: a compressor configured to compress outside air, a combustor configured to mix fuel with the air compressed by the compressor to burn a mixture thereof, and a turbine configured to be rotated by combustion gas discharged from the combustor. The turbine may include a turbine blade including an airfoil, a platform, and a root, a turbine rotor disk to which the root of the turbine blade is mounted, a seal plate mounted between the platform and one side of the turbine rotor disk to seal a cooling channel defined within the root and the platform, an insertion pin inserted through the turbine rotor disk and the seal plate to fix the seal plate to the turbine rotor disk, and a retainer configured to fix the insertion pin and to prevent the insertion pin from falling out.

The turbine rotor disk may include a mounting rib extending from one side thereof to form a mounting groove into which a radially inner end of the seal plate is inserted, and a through-hole formed through the mounting rib for insertion of the insertion pin.

The seal plate may include a pinhole formed therethrough at a position corresponding to the through-hole of the mounting rib.

The insertion pin may include a cylindrical body, a head integrally formed at one side of the body and having an outer diameter larger than that of the body, and a cutout formed on a bottom of the body and the head so that the retainer is pressed against the cutout.

The insertion pin may further include a groove formed on the head, the groove being stepped from the cutout while extending thereto, and the retainer being pressed against the groove.

The retainer may be formed by bending a rectangular plate and may include a horizontal portion that is bent by plastic deformation, a stepped portion connected from the horizontal portion in a stepped manner, and a vertical portion bent vertically from the stepped portion.

The head of the insertion pin may be supported by a bent portion formed by bending a portion of the horizontal portion after the retainer is inserted into the through-hole of the mounting rib and the insertion pin is inserted into the through-hole.

According to an aspect of another exemplary embodiment, there is provided a method of assembling turbine blade seals including: inserting and mounting a root of a turbine blade in a slot of a turbine rotor disk, mounting a seal plate between a platform of the turbine blade and a mounting rib of the turbine rotor disk, inserting and mounting a retainer in a through-hole formed in the mounting rib, inserting and mounting an insertion pin in the through-hole of the mounting rib and a pinhole formed in the seal plate, and bending a portion of the retainer protruding from the mounting rib to support the insertion pin.

The turbine rotor disk may include the mounting rib extending from one side thereof to form a mounting groove into which a radially inner end of the seal plate is inserted, and the through-hole formed through the mounting rib for insertion of the insertion pin.

The insertion pin may include a cylindrical body, a head integrally formed at one side of the body and having an outer diameter larger than that of the body, a cutout formed on the bottom of the body and the head so that the retainer is pressed against the cutout, and a groove formed on the head, the groove being stepped from the cutout while extending thereto, and the retainer being pressed against the groove.

The retainer may be formed by bending a rectangular plate and may include a horizontal portion that is bent by plastic deformation, a stepped portion connected from the horizontal portion in a stepped manner, and a vertical portion bent vertically from the stepped portion.

A bent portion formed by bending a portion of the horizontal portion may be disposed inside the through-hole of the turbine rotor disk.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
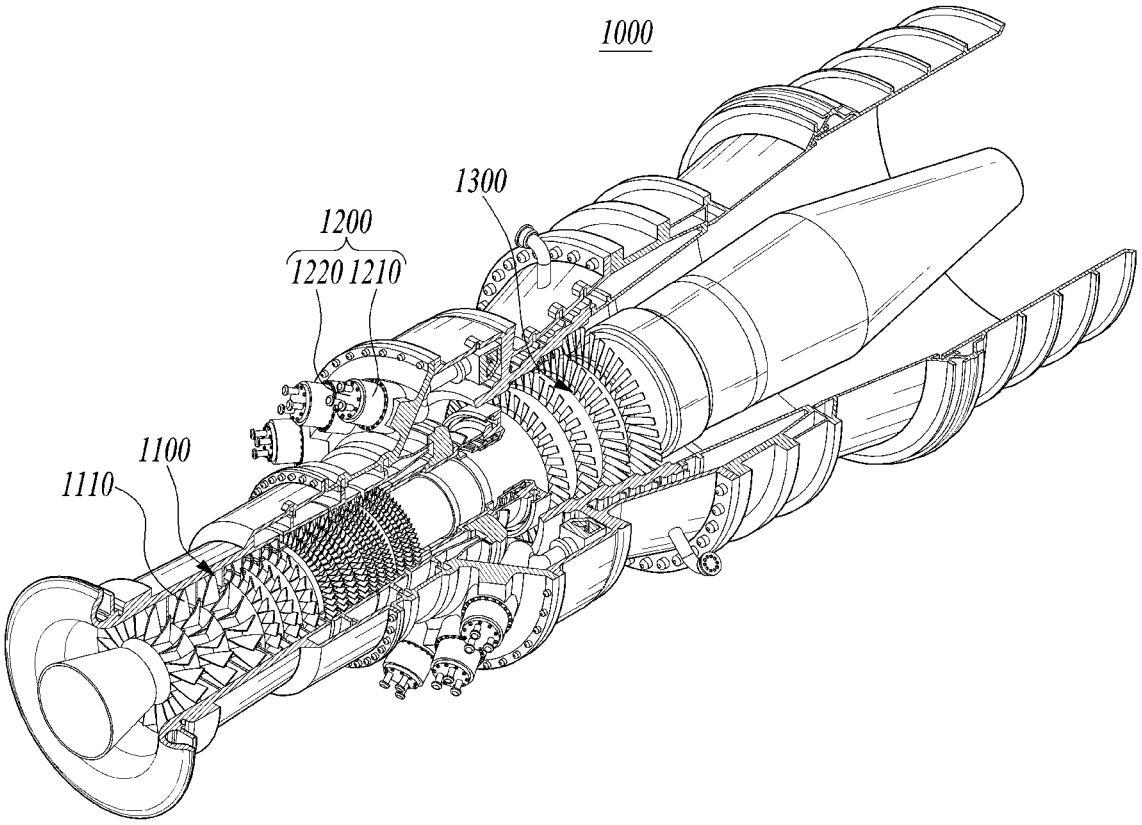
FIG. 1 is a partial cutaway perspective view illustrating a gas turbine according to an exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Hereinafter, exemplary embodiments will be described in detail with reference to the accompanying drawings. It should be noted that like reference numerals refer to like parts throughout the different drawings and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
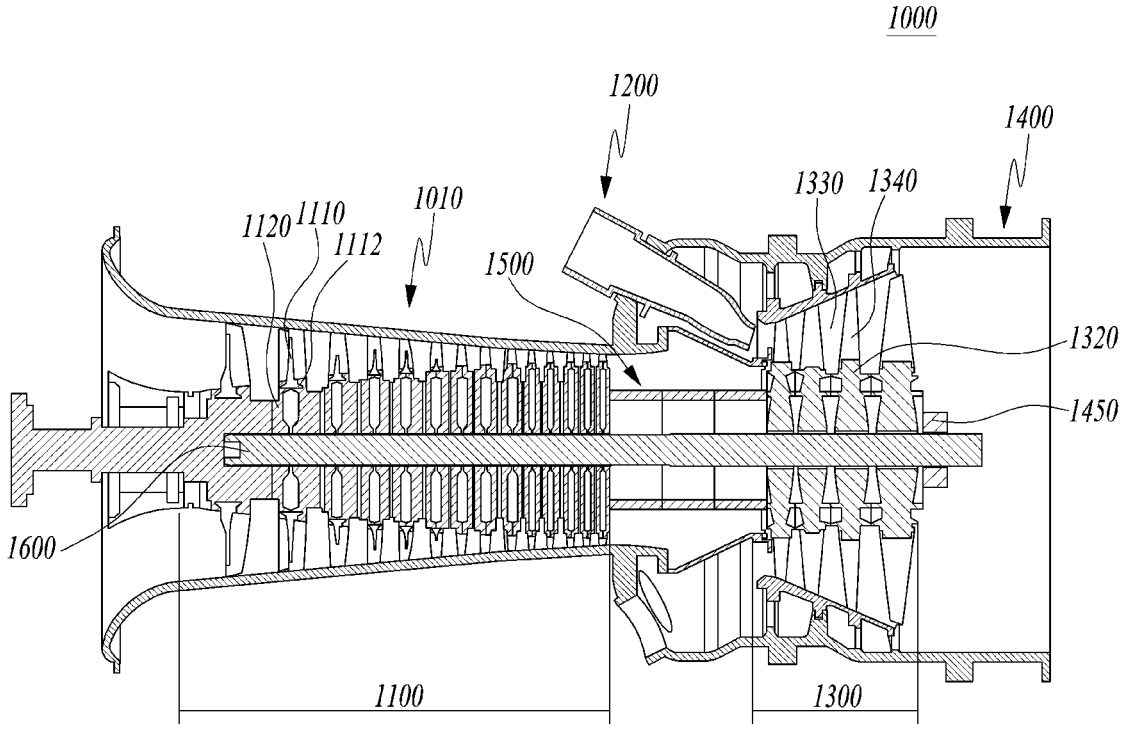
FIG. 2 is a cross-sectional view illustrating a schematic structure of the gas turbine according to the exemplary embodiment.
Figure 3:
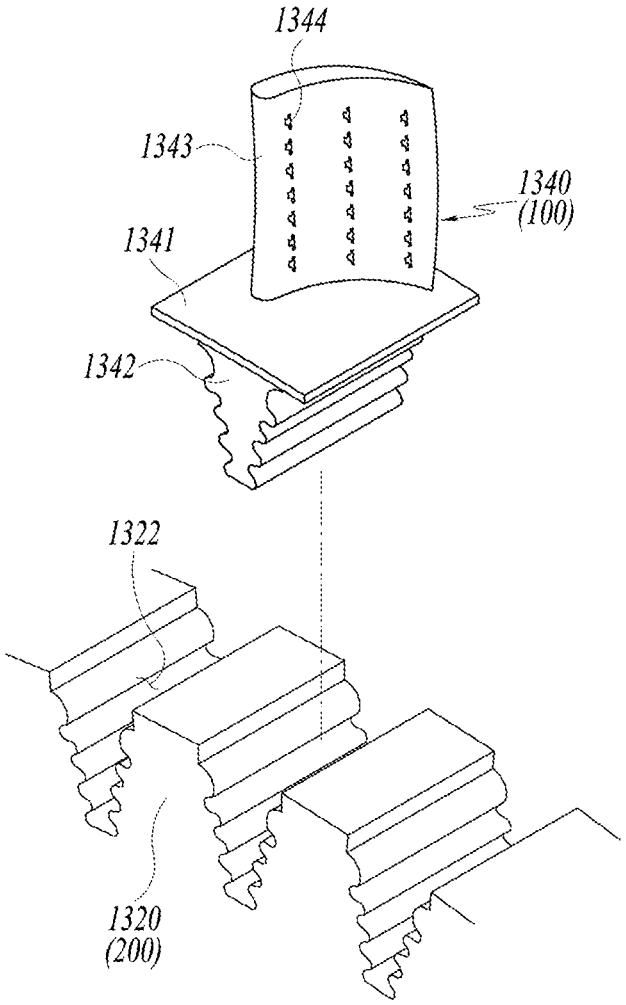
FIG. 3 is an exploded perspective view illustrating a turbine rotor disk of FIG. 2.

FIG. 1 is a partial cutaway perspective view illustrating a gas turbine according to an exemplary embodiment. FIG. 2 is a cross-sectional view illustrating a schematic structure of the gas turbine according to the exemplary embodiment. FIG. 3 is an exploded perspective view illustrating a turbine rotor disk of FIG. 2.

Referring to FIG. 1, the gas turbine 1000 according to the exemplary embodiment includes a compressor 1100, a combustor 1200, and a turbine 1300. The compressor 1100 includes a plurality of blades 1110 which are arranged radially. The compressor 1100 rotates the plurality of blades 1110, and air is compressed and flows by the rotation of the plurality of blades 1110. A size and installation angle of each of the plurality of blades 1110 may vary depending on an installation position thereof. The compressor 1100 may be directly or indirectly connected to the turbine 1300, and receive some of power generated by the turbine 1300 and use the received power to rotate the plurality of blades 1110.

The air compressed by the compressor 1100 flows to the combustor 1200. The combustor 1200 includes a plurality of combustion chambers 1210 and fuel nozzle modules 1220 which are arranged in an annular shape.

Referring to FIG. 2, the gas turbine 1000 includes a housing 1010 and a diffuser 1400 disposed behind the housing 1010 to discharge the combustion gas passing through the turbine 1300. The combustor 1200 is disposed in front of the diffuser 1400 to combust the compressed air supplied thereto.

Based on a flow direction of air, the compressor 1100 is disposed at an upstream side, and the turbine 1300 is disposed at a downstream side. Between the compressor 1100 and the turbine 1300, a torque tube 1500 serving as a torque transmission member for transmitting the rotational torque generated in the turbine 1300 to the compressor 1100 is disposed.

The compressor 1100 includes a plurality of compressor rotor disks 1120, each of which is fastened by a tie rod 1600 to prevent axial separation in an axial direction of the tie rod 1600.

For example, the compressor rotor disks 1120 are aligned with each other along an axial direction in such a way that the tie rod 1600 forming a rotary shaft passes through centers of the compressor rotor disks 1120. Here, adjacent compressor rotor disks 1120 are arranged so that facing surfaces thereof are in tight contact with each other by the tie rod 1600. The adjacent compressor rotor disks 1120 cannot rotate relative to each other because of this arrangement.

Each of the compressor rotor disks 1120 has a plurality of blades 1110 radially coupled to an outer peripheral surface thereof. Each of the blades 1110 has a dovetail 1112 fastened to the compressor rotor disk 1120.

A plurality of compressor vanes are fixedly arranged between each of the compressor rotor disks 1120. While the compressor rotor disks 1120 rotate along with a rotation of the tie rod 1600, the compressor vanes fixed to the housing 1010 do not rotate. The compressor vanes guide a flow of compressed air moved from front-stage compressor blades 1110 of the compressor rotor disk 1120 to rear-stage compressor blades 1110 of the compressor rotor disk 1120.

The dovetail 1112 may be fastened in a tangential type or an axial type, which may be selected according to the structure required for the gas turbine used. This type may have a dovetail shape or fir-tree shape. In some cases, the compressor blades 1110 may be fastened to the compressor rotor disk 1120 by using other types of fastener, such as a key or a bolt.

The tie rod 1600 is disposed to pass through centers of the plurality of compressor rotor disks 1120 and turbine rotor disks 1320. The tie rod 1600 may be a single tie rod or consist of a plurality of tie rods. One end of the tie rod 1600 is fastened to the compressor rotor disk that is disposed at the most upstream side, and the other end thereof is fastened by a fixing nut 1450.

It is understood that the tie rod 1600 may have various shapes depending on the structure of the gas turbine, and is not limited to example illustrated in FIG. 2. For example, a single tie rod may be disposed to pass through the centers of the rotor disks, a plurality of tie rods may be arranged circumferentially, or a combination thereof may be used.

Also, a deswirler serving as a guide vane may be installed at the rear stage of the diffuser in order to increase the pressure of fluid in the compressor of the gas turbine and to adjust an actual flow angle of the fluid entering into an inlet of the combustor.

The combustor 1200 mixes fuel with the introduced compressed air, burns a mixture thereof to produce high-temperature and high-pressure combustion gas with high energy, and increases the temperature of the combustion gas to a heat-resistant limit of combustor and turbine components through an isobaric combustion process.

A plurality of combustors constituting the combustor 1200 may be arranged in the housing in a form of a shell. Each of the combustors may include a burner having a fuel injection nozzle and the like, a combustor liner defining a combustion chamber, and a transition piece serving as a connection between the combustor and the turbine.

The combustor liner provides a combustion space in which the fuel injected by the fuel injection nozzle is mixed with the compressed air supplied from the compressor. The combustor liner may include a flame container providing the combustion space in which the mixture of air and fuel is burned, and a flow sleeve defining an annular space surrounding the flame container. The fuel injection nozzle is coupled to a front end of the combustor liner, and an ignition plug is coupled to a side wall of the combustor liner.

The transition piece is connected to a rear end of the combustor liner to transfer the combustion gas, burned by the ignition plug, toward the turbine. An outer wall of the transition piece is cooled by the compressed air supplied from the compressor to prevent the transition piece from being damaged by the high temperature of the combustion gas.

To this end, the transition piece has cooling holes through which the compressed air can be injected. The compressed air cools inside of the transition piece through the cooling holes and then flows toward the combustor liner.

The compressed air used to cool the transition piece may flow in the annular space of the combustor liner, and may impinge on the cooling air supplied from the outside of the flow sleeve through the cooling holes formed in the flow sleeve to an outer wall of the combustor liner.

The high-temperature and high-pressure combustion gas ejected from the combustor 1200 is supplied to the turbine 1300. The supplied high-temperature and high-pressure combustion gas expands and impinges on the blades of the turbine and applies impingement or reaction force to the turbine blades to generate rotational torque. A portion of the rotational torque is transmitted via the torque tube to the compressor, and the remaining portion which is the excessive torque is used to drive a generator or the like.

The turbine 1300 basically has a structure similar to that of the compressor. That is, the turbine 1300 also includes a plurality of turbine rotor disks 1320 similar to the compressor rotor disks of the compressor. Accordingly, each of the turbine rotor disks 1320 includes a plurality of turbine blades 1340 arranged radially. The turbine blades 1340 may also be coupled to the turbine rotor disk 1320 in a dovetail manner or the like. In addition, a plurality of turbine vanes 1330 fixed in a turbine casing are provided between the turbine blades 1340 of the turbine rotor disk 1320 to guide a flow direction of the combustion gas passing through the turbine blades 1340.

Referring to FIG. 3, each of the turbine rotor disks 1320 has a substantially disk shape, and includes a plurality of coupling slots 1322 formed in an outer peripheral portion thereof. Each of the coupling slots 1322 has a fir-tree-shaped curved surface.

Each of the turbine blades 1340 is fastened to an associated one of the coupling slots 1322 and includes a flat platform 1341 formed in an approximately central portion thereof. The platform 1341 has a side surface which comes into contact with a side surface of the platform 1341 of an adjacent turbine blade to maintain a distance between the adjacent blades.

A root 1342 is formed on a bottom of the platform 1341. The root 1342 has an axial-type so that the root 1342 is inserted into the coupling slot 1322 of the turbine rotor disk 1320 along an axial direction of the turbine rotor disk 1320.

The root 1342 has an approximately fir-tree-shaped curved portion corresponding to the fir-tree-shaped curved portion formed in the coupling slot 1322. It is understood that the coupling structure of the root 1342 is not limited to the fir-tree shape, and may be formed to have a dovetail structure.

An airfoil 1343 is formed on an upper surface of the platform 1341 to have an optimized airfoil shape according to specification of the gas turbine. Based on a flow direction of combustion gas, the airfoil 1343 has a leading edge disposed at an upstream side and a trailing edge disposed at a downstream side.

The turbine blades come into direct contact with high-temperature and high-pressure combustion gas. Because the combustion gas has a high temperature reaching 1700° C., the turbine requires a cooling device. To this end, the turbine has a cooling passage through which some of the compressed air is bled from some portions of the compressor and is supplied to the turbine blades.

The cooling passage may extend outside the turbine casing (i.e., an external passage), or extend through the inside of the turbine rotor disk (i.e., an internal passage, or both of the external passage and the internal passage may be used. A plurality of film cooling holes 1344 are formed on a surface of the airfoil 1343. The film cooling holes 1344 serve to communicate with a cooling channel defined within the airfoil 1343 so that the cooling air is supplied to the surface of the airfoil 1343.

The blades 1340 of the turbine are rotated by combustion gas in the turbine casing. There is a clearance between a tip of each of the turbine blades 1340 and the inner surface of the turbine casing such that the turbine blade is smoothly rotatable. However, because the combustion gas may leak through the clearance, a sealing device to prevent the leakage of the combustion gas is required.

Each of the turbine vanes and the turbine blades having an airfoil shape includes a leading edge, a trailing edge, a suction side, and a pressure side. The turbine vane and the turbine blade have a complicated labyrinth structure forming a cooling system. A cooling circuit in the turbine vane and the turbine blade receives a cooling fluid, e.g., air from the compressor, and the fluid passes through the end of the turbine vane or turbine blade. The cooling circuit includes a plurality of flow paths to maintain temperatures of all surfaces of the turbine vane or blade constant. At least a portion of the fluid passing through the cooling circuit is discharged through the openings of the leading edge, the trailing edge, the suction side, and the pressure side of the turbine vane or blade.

Figure 4:
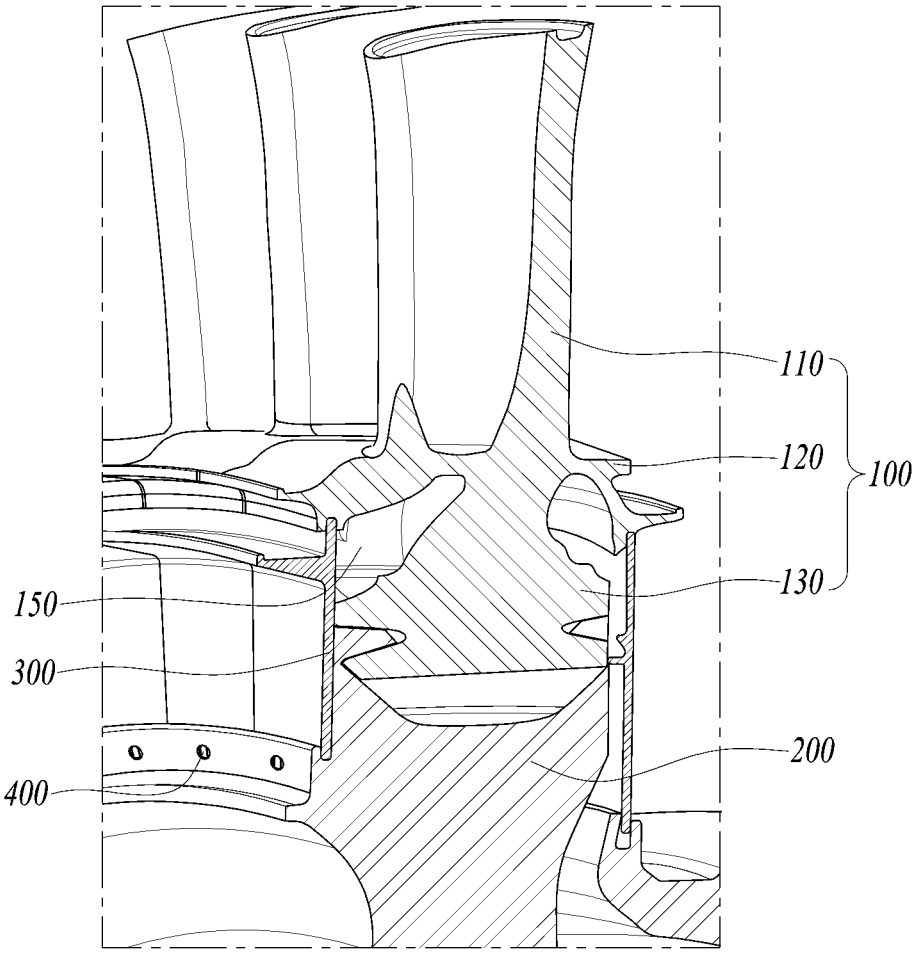
FIG. 4 is a partial cutaway perspective view illustrating a structure for assembling turbine blade seals according to an exemplary embodiment.
Figure 5:
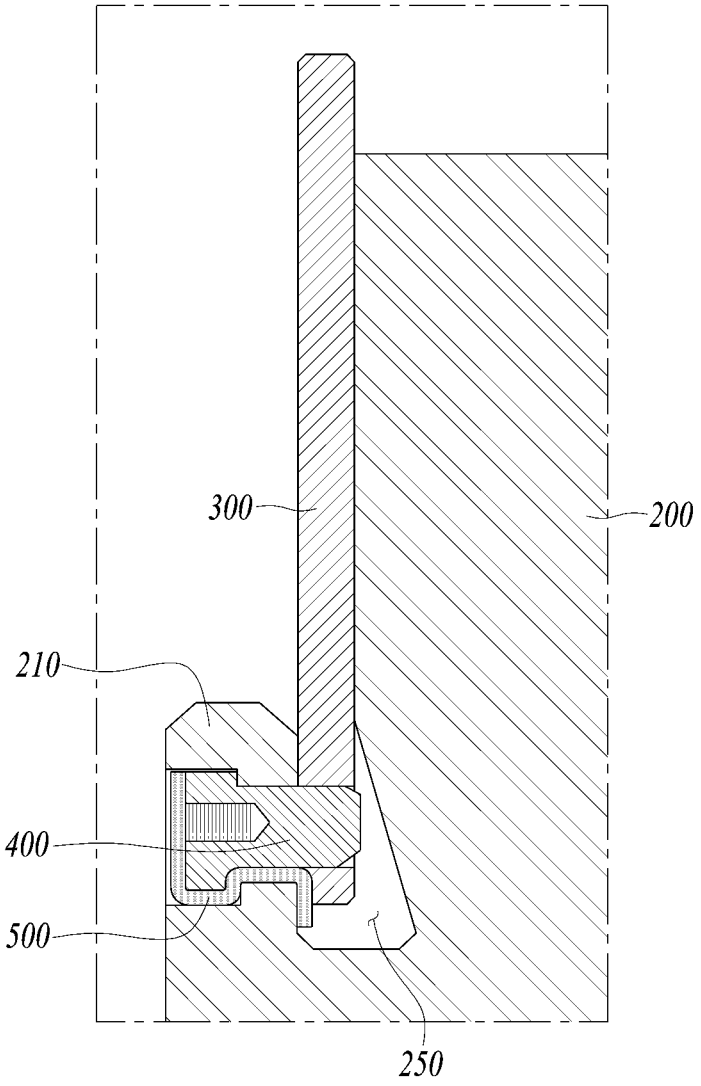
FIG. 5 is a partial cross-sectional view illustrating the structure for assembling turbine blade seals according to the exemplary embodiment.
Figure 6:
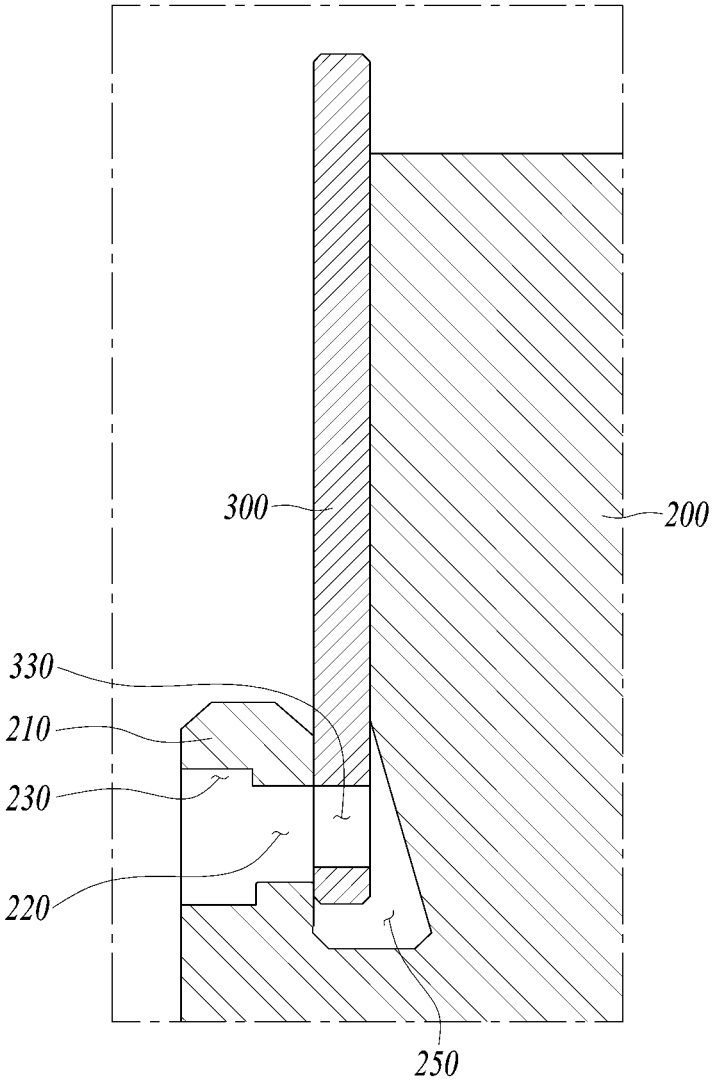
FIG. 6 is a partial cross-sectional view of FIG. 5 in which an insertion pin and a retainer are omitted.
Figure 7:
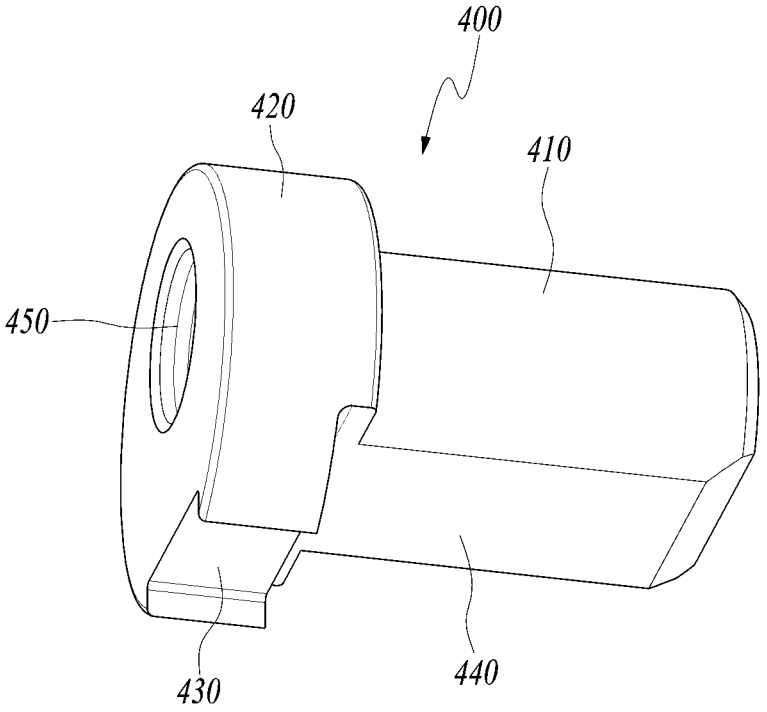
FIG. 7 is a perspective view illustrating an insertion pin of FIG. 5.
Figure 8:
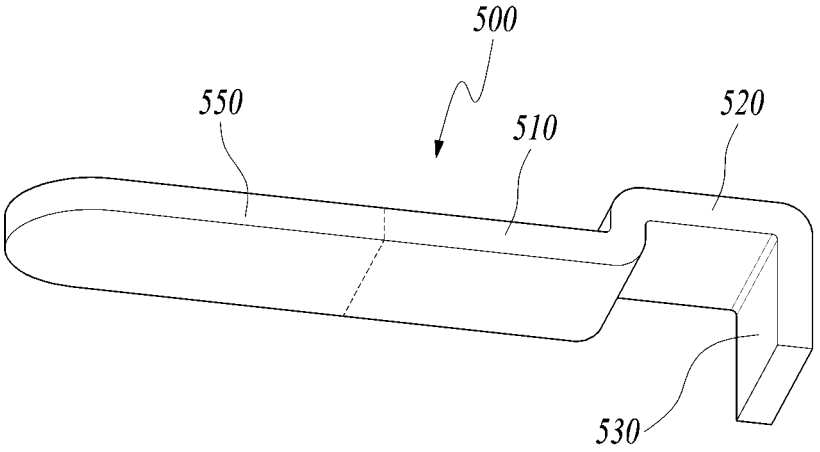
FIG. 8 is a perspective view illustrating a retainer of FIG. 5.

FIG. 4 is a partial cutaway perspective view illustrating a structure for assembling turbine blade seals according to an exemplary embodiment. FIG. 5 is a partial cross-sectional view illustrating the structure for assembling turbine blade seals according to the exemplary embodiment. FIG. 6 is a partial cross-sectional view of FIG. 5 in which an insertion pin and a retainer are omitted. FIG. 7 is a perspective view illustrating an insertion pin of FIG. 5. FIG. 8 is a perspective view illustrating a retainer of FIG. 5.

Referring to FIGS. 4 and 5, the structure for assembling turbine blade seals according to the exemplary embodiment includes a turbine blade 100 (or also designated by reference numeral 1340) having an airfoil 110 (or also designated by reference numeral 1343), a platform 120 (or also designated by reference numeral 1341), and a root 130 (or also designated by reference numeral 1342), a turbine rotor disk 200 (or also designated by reference numeral 1320) to which the root 130 of the turbine blade 100 is mounted, a seal plate 300 mounted between the platform 120 and one side of the turbine rotor disk 200 to seal a cooling channel 150 defined within the root 130 and the platform 120, an insertion pin 400 inserted through the turbine rotor disk 200 and the seal plate 300 to fix the seal plate 300 to the turbine rotor disk 200, and a retainer 500 configured to fix the insertion pin 400 and prevent the insertion pin 400 from falling out.

The airfoil 110 of the turbine blade 100 includes a leading edge, a trailing edge, a convex suction side on one side thereof, and a concave pressure side on the other side thereof.

The platform 120 having a substantially flat shape may be integrally formed on a radially inner side of the airfoil 110. The platform 120 may have a circumferential width greater than a thickness of the airfoil 110.

The root 130 may extend radially inward from the platform 120 and may be formed integrally therewith. The root 130 may have an approximately fir-tree-shaped curved surface. As illustrated in FIG. 3, the root 130 (1342) may be inserted and mounted in each coupling slot 1322 of the turbine rotor disk 200 (1320) having a fir-tree-shaped curved surface corresponding thereto.

The turbine rotor disk 200 may have a circular disk shape as a whole. The turbine rotor disk 200 may have a through-hole formed in center to allow the tie rod 1600 to pass therethrough, and the plurality of coupling slots 1322 arranged at regular intervals on the outer peripheral surface thereof may be formed. The root 130 of the turbine blade 100 may be inserted and mounted in each of the coupling slots 1322.

In FIG. 4, the root 130 of the turbine blade 100 may be circumferentially inserted and mounted in the coupling slot of the turbine rotor disk 200. That is, the turbine blade of FIG. 3 may be mounted to the turbine rotor disk in an axial type, and the turbine blade of FIG. 4 may be mounted to the turbine rotor disk in a tangential type.

The cooling channel 150 may be defined within the root 130 and the platform 120 to supply cooling air to the turbine blade 100. The seal plate 300 may be mounted between the platform 120 and one side of the turbine rotor disk 200 to seal the cooling channel 150.

The insertion pin 400 may be inserted into through-holes formed in each of the turbine rotor disk 200 and the seal plate 300 to fix the seal plate 300 to the turbine rotor disk 200.

The insertion pin 400 may be inserted into the through-holes formed in each of the turbine rotor disk 200 and the seal plate 300, and the retainer 500 may be mounted in the through-hole of the turbine rotor disk 200 to fix the insertion pin 400 and prevent the insertion pin 400 from falling out.

Referring to FIG. 6, the turbine rotor disk 200 may include a mounting rib 210 extending from one side thereof to form a mounting groove 250 into which the radially inner end of the seal plate 300 is inserted, and a through-hole 220 penetrating the mounting rib 210 to allow insertion of the insertion pin 400.

The mounting rib 210 may extend radially outward from one side of the turbine rotor disk 200, and have an upper end chamfered or rounded at an edge thereof. The mounting groove 250 having a substantially trapezoidal shape in the cross-sectional view may be formed between the turbine rotor disk 200 and the mounting rib 210. The radially inner end of the seal plate 300 may be inserted into the mounting groove 250 which is larger than the end of the seal plate 300.

The through-hole 220 into which the insertion pin 400 is inserted may be formed in the mounting rib 210. Because the retainer 500 and the insertion pin 400 are inserted and mounted in the through-hole 220, the through-hole 220 may be formed so that the insertion pin 400 and the retainer 500 can be inserted.

The seal plate 300 may include a pinhole 330 formed therethrough at a position corresponding to the through-hole 220 of the mounting rib 210. The pinhole 330 may have a circle shape passing through the inner lower portion of the seal plate 300 in the radial direction. A front end of the insertion pin 400 may be inserted into the pinhole 330.

Referring to FIG. 7, the insertion pin 400 may include a cylindrical body 410, a head 420 integrally formed at one side of the body 410 and having a larger outer diameter than the body 410, and a cutout 440 formed on a bottom of the body 410 and the head 420 so that the retainer 500 is pressed against the cutout 440.

The body 410 may have a cylindrical shape, the head 420 may have a cylindrical shape having an outer diameter larger than that of the body 410, and the body 410 and the head 420 may be formed integrally with each other in a stepped manner.

The cutout 440 to which the retainer 500 is pressed may be formed on the entire bottom of the body 410 and on a portion of the bottom of the head 420. The cutout 440 may have a flat cutout surface, and the head 420 may have a stepped surface perpendicular to the cutout surface at the middle of the bottom thereof. In addition, the cutout 440 may have a chamfer formed in a vicinity of the end of the body 410.

The insertion pin 400 may further include a groove 430 formed on the head 420. The groove 430 is stepped from the cutout 440 while extending thereto, and the retainer 500 is pressed against the groove 430. The groove 430 may be shallower than the cutout 440 to form a step from the cutout 440. The cutout 440 may have a flat surface extending to the circumferential surface of the insertion pin 400 in a width direction, and the groove 430 may have a bottom stepped from the circumferential surface of the head 420 because the groove 430 has a width smaller than the outer diameter of the head 420.

The insertion pin 400 may have a screw hole 450 formed in a longitudinal direction from one side of the head 420. The screw hole 450 may be formed at a position slightly inclined toward the opposite side of the groove 430 rather than the center of the head 420. The screw hole 450 may have a depth larger than the length of the head 420. The screw hole 450 has a thread formed on the inner peripheral surface thereof. Accordingly, when the insertion pin 400 is to be disassembled, the insertion pin 400 may be easily separated from the through-hole 220 by fastening a bolt to the screw hole 450 and pulling the bolt.

As illustrated in FIG. 6, the turbine rotor disk 200 may have a head receiving hole 230 formed on one side of the through-hole 220 thereof and having an inner diameter larger than the through-hole 220, so that the head 420 of the insertion pin 400 is received in the head receiving hole 230.

The head receiving hole 230 has a larger diameter than the through-hole 220 to be stepped from the through-hole 220, thereby enabling the head 420 of the insertion pin 400 to be received in position. The head receiving hole 230 may have a depth larger than the length of the head 420. Accordingly, a bent portion 550 of the retainer 500 may be entirely received in the head receiving hole 230.

Referring to FIG. 8, the retainer 500 may be formed by bending a rectangular plate, and include a horizontal portion 510 that is bent by plastic deformation, a stepped portion 520 connected from the horizontal portion 510 in a stepped manner, and a vertical portion 530 that is bent vertically from the stepped portion 520.

The retainer 500 may be formed by bending a rectangular metal plate having a predetermined width, length, and thickness. The retainer 500 may be made of a material that is easily bendable as a whole by plastic deformation, or may be made of a material in which only the horizontal portion 510 is bent by plastic deformation after the retainer 500 is inserted.

The horizontal portion 510 may be an elongated rectangular plate, and as illustrated in FIG. 5, a non-bent portion of the horizontal portion 510 may be inserted into the groove 430 of the insertion pin 400.

The stepped portion 520 may be formed to be bent horizontally after bending upward from one end of the horizontal portion 510. As illustrated in FIG. 5, the stepped portion 520 may be mounted between the cutout 440 of the insertion pin 400 and the through-hole 220.

The vertical portion 530 may be formed to be bent downward from one end of the stepped portion 520. The vertical portion 530 may be two or more times longer than a height of the stepped portion 520. As illustrated in FIG. 5, the vertical portion 530 may be pressed against the inner surface of the mounting rib 210 to fix the retainer 500 and to prevent the retainer 500 from falling out.

The retainer 500 may further include a bent portion 550. As illustrated in FIG. 5, the head 420 of the insertion pin 400 may be supported by the bent portion 550 formed by bending a portion of the horizontal portion 510 after the retainer 500 is inserted into the through-hole 220 of the mounting rib 210 and the insertion pin 400 is inserted into the through-hole 220.

In this case, because the bent portion 550 is disposed inside the head receiving hole 230, it is possible to prevent the retainer 500 and the head 420 of the insertion pin 400 from protruding from the outer surface of the mounting rib 210.

Figure 9:
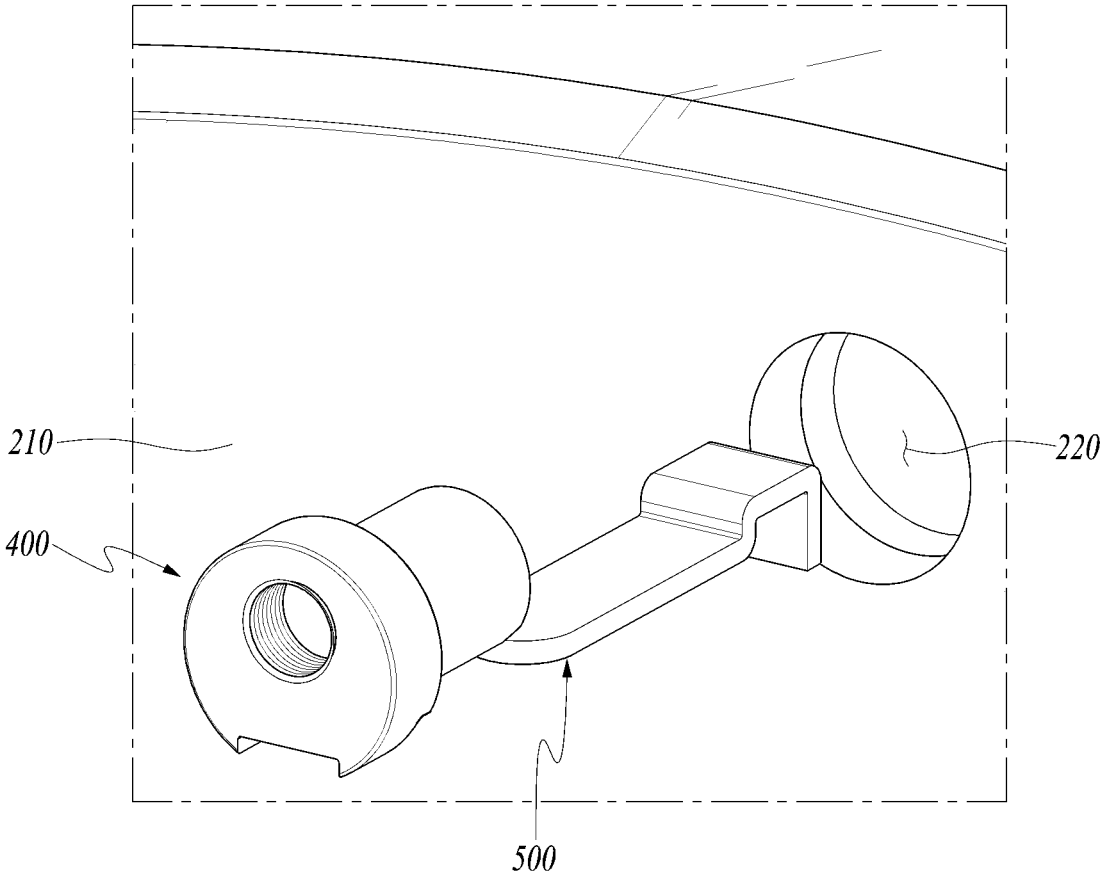
FIGS. 9 to 11 are views illustrating a process of assembling a seal plate to a turbine rotor disk using an insertion pin and a retainer according to an exemplary embodiment.
Figure 10:
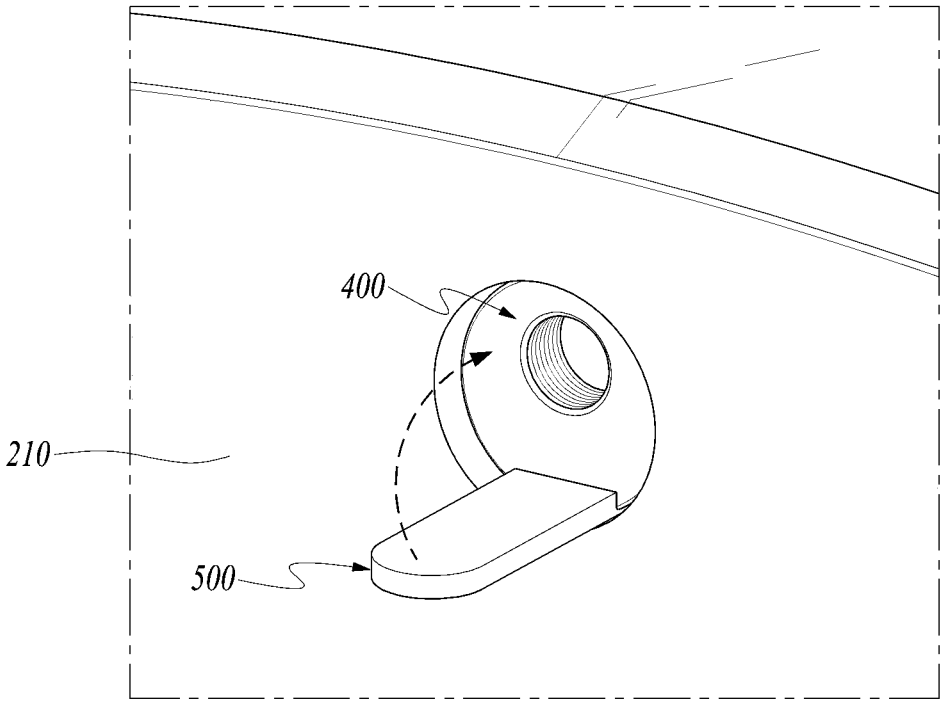
Figure 11:
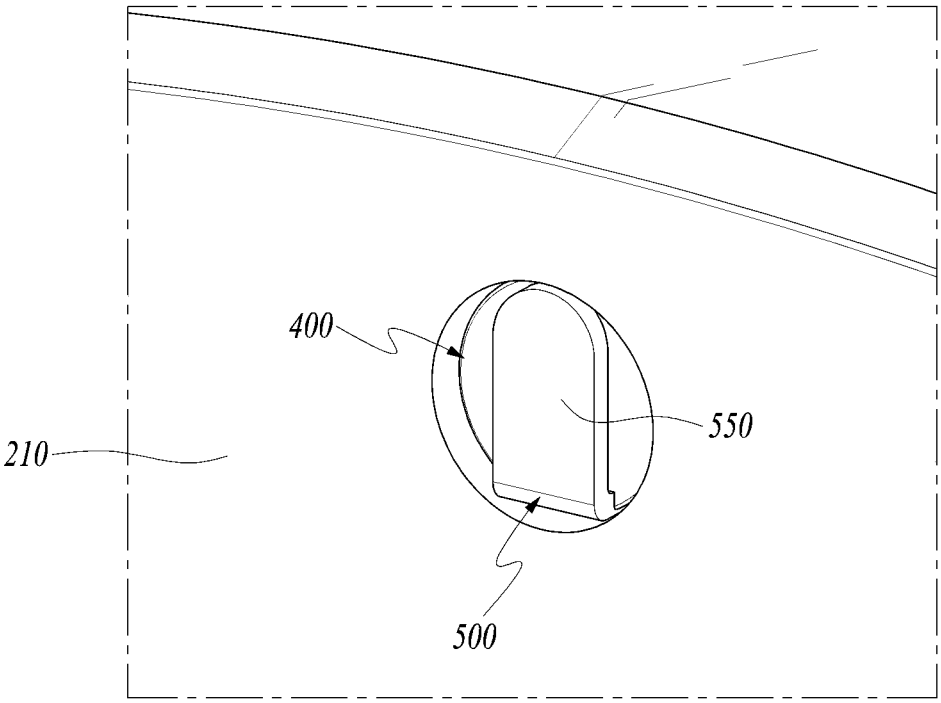

FIGS. 9 to 11 are views illustrating a process of assembling the seal plate to the turbine rotor disk using an insertion pin and a retainer according to an exemplary embodiment.

Hereinafter, a method of assembling turbine blade seals will be described with reference to the drawings.

First, as illustrated in FIG. 4, the root 130 of the turbine blade 100 is inserted and mounted in the slot of the turbine rotor disk 200.

Next, as illustrated in FIG. 6, the seal plate 300 is mounted between the platform 120 of the turbine blade 100 and the mounting rib 210 of the turbine rotor disk 200. In this case, the radially inner end of the seal plate 300 may be inserted into the mounting groove 250.

Next, as illustrated in FIG. 9, the retainer 500 is inserted and mounted in the through-hole 220 formed in the mounting rib 210. In this case, in a state in which the horizontal portion 510 of the retainer 500 is not bent, the stepped portion 520 and the vertical portion 530 may be inserted and mounted in the through-hole 220.

Next, as illustrated in FIGS. 9 and 10, the insertion pin 400 is inserted and mounted in the through-hole 220 of the mounting rib 210 and the pinhole 330 formed in the seal plate 300. In this case, the stepped portion between the body 410 and the head 420 of the insertion pin 400 may be inserted so as to be pressed against and supported by the stepped portion between the through-hole 220 and the head receiving hole 230. In addition, the insertion pin 400 may be inserted and mounted so that the stepped portion 520 and the horizontal portion 510 of the retainer 500 are in contact with the cutout 440 and the groove 430 of the insertion pin 400.

Next, as illustrated in FIG. 10, a portion of the retainer 500 protruding out of the mounting rib 210 is bent to support the insertion pin 400. That is, the bent portion 550 formed by vertically bending the protruding end of the horizontal portion 510 of the retainer 500 may be pressed against the head 420 of the insertion pin 400 to support the insertion pin 400.

Referring to FIG. 11, the bent portion 550 formed by bending a portion of the horizontal portion 510 may be disposed inside the through-hole 220 of the turbine rotor disk 200. That is, because the insertion pin 400 or the retainer 500 does not protrude from the outer surface of the mounting rib 210, it is possible to prevent a flow loss due to friction with gas in the protruding portion.

According to the structure for assembling turbine blade seals, the gas turbine including the same, and the method of assembling turbine blade seals, it is possible to reduce a windage loss due to gas friction by removing a portion of the fixing member protruding from the seal plate and the turbine rotor disk, wherein the fixing member serves to fix the lower end of the seal plate to the turbine rotor disk, and it is possible to improve the structural stability of the turbine blade by minimizing the load applied to the root of the turbine blade.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims. Accordingly, the description of the exemplary embodiments should be construed in a descriptive sense only and not to limit the scope of the claims, and many alternatives, modifications, and variations will be apparent to those skilled in the art.

What is claimed is:

1. A structure for assembling turbine blade seals comprising:

a turbine blade comprising an airfoil, a platform, and a root;

a turbine rotor disk to which the root of the turbine blade is mounted;

a seal plate mounted between the platform and one side of the turbine rotor disk to seal a cooling channel defined within the root and the platform;

an insertion pin inserted through the turbine rotor disk and the seal plate to fix the seal plate to the turbine rotor disk; and a retainer configured to fix the insertion pin and to prevent the insertion pin from falling out, wherein the turbine rotor disk comprises:

a mounting rib extending from one side thereof to form a mounting groove into which a radially inner end of the seal plate is in inserted; and a through-hole formed through the mounting rib for insertion of the insertion pin, wherein the seal plate comprises a pinhole formed therethrough at a position corresponding to the through-hole of the mounting rib, wherein the insertion pin comprises:

a cylindrical body;

a head integrally formed at one side of the body and having an outer diameter larger than that of the body;

a cutout formed on a bottom of the body and the bead so that the retainer is pressed against the cutout; and a groove formed on the head, the groove being stepped from the cutout while extending thereto, and the retainer being pressed against the groove, wherein the turbine rotor disk comprises a head receiving hole formed on one side of the through-hole and having an inner diameter larger than the through-hole so that the head of the insertion pin is received in the head receiving hole, wherein the retainer is formed by bending a rectangular plate, and comprises:

a horizontal portion that is bent by plastic deformation;

a stepped portion connected from the horizontal portion in a stepped manner; and a vertical portion bent vertically from the stepped portion, wherein the head of the insertion pin is supported by a bent portion formed by bending a portion of the horizontal portion after the retainer is inserted into the through-hole of the mounting rib and the insertion pin is inserted into the through-hole, and wherein the bent portion is disposed inside the head receiving hole after bending and the retainer does not protrude from the outer surface of the mounting rib.

2. The structure for assembling turbine blade seals of claim 1, wherein a connecting portion of the retainer between the horizontal portion and the stepped portion is disposed between the head of the insertion pin and the through-hole of the mounting rib, thereby preventing the insertion pin from moving toward an inserting direction of the insertion pin.

3. The structure for assembling turbine blade seals of claim 1, wherein the groove is formed on the bottom of the head and is stepped from the cutout while extending thereto in an axial direction of the insertion pin.

4. The structure for assembling turbine blade seals of claim 1, wherein the retainer is formed with two grooves, the two grooves facing opposite directions to each other, one groove receiving a portion of the head of the insertion pin and the other groove receiving a portion of the mounting rib.

5. A gas turbine comprising:

a compressor configured to compress outside air;

a combustor configured to mix fuel with the air compressed by the compressor to burn a mixture thereof; and a turbine configured to be rotated by combustion gas discharged from the combustor, wherein the turbine comprises:

a turbine blade comprising an airfoil, a platform, and a root;

a turbine rotor disk to which the root of the turbine blade is mounted;

a seal plate mounted between the platform and one side of the turbine rotor disk to seal a cooling channel defined within the root and the platform;

an insertion pin inserted through the turbine rotor disk and the seal plate to fix the seal plate to the turbine rotor disk; and a retainer configured to fix the insertion pin and to prevent the insertion pin from falling out, wherein the turbine rotor disk comprises:

a mounting rib extending from one side thereof to form a mounting groove into which a radially inner end of the seal plate is inserted; and a through-hole formed through the mounting rib for insertion of the insertion pin, wherein the seal plate comprises a pinhole formed therethrough at a position corresponding to the through-hole of the mounting rib, wherein the insertion pin comprises:

a cylindrical body;

a head integrally formed at one side of the body and having an outer diameter larger than that of the body;

a cutout formed on a bottom of the body and the head so that the retainer is pressed against the cutout; and a groove formed on the head, the groove being stepped from the cutout while extending thereto, and the retainer being pressed against the groove, wherein the turbine rotor disk comprises a head receiving hole formed on one side of the through-hole and having an inner diameter larger than the through-hole so that the head of the insertion pin is received in the head receiving hole, wherein the retainer is formed by bending a rectangular plate, and comprises:

a horizontal portion that is bent by plastic deformation;

a stepped portion connected from the horizontal portion in a stepped manner; and a vertical portion bent vertically from the stepped portion, wherein the head of the insertion pin is supported by a bent portion formed by bending a portion of the horizontal portion after the retainer is inserted into the through-hole of the mounting rib and the insertion pin is inserted into the through-hole, and wherein the bent portion is disposed inside the head receiving hole after bending and the retainer is not protruded from the outer surface of the mounting rib.

6. A method of assembling turbine blade seals comprising:

inserting and mounting a root of a turbine blade in a slot of a turbine rotor disk;

mounting a seal plate between a platform of the turbine blade and a mounting rib of the turbine rotor disk;

inserting and mounting a retainer in a through-hole formed in the mounting rib;

inserting and mounting an insertion pin in the through-hole of the mounting rib and a pinhole formed in the seal plate; and bending a portion of the retainer protruding from the mounting rib to support the insertion pin, wherein the turbine rotor disk comprises:

a mounting rib extending from one side thereof to form a mounting groove into which a radially inner end of the seal plate is inserted; and a through-hole formed through the mounting rib for insertion of the insertion pin, wherein the seal plate comprises a pinhole formed therethrough at a position corresponding to the through-hole of the mounting rib, wherein the insertion pin comprises:

a cylindrical body;

a head integrally formed at one side of the body and having an outer diameter larger than that of the body;

a cutout formed on a bottom of the body and the head so that the retainer is pressed against the cutout; and a groove formed on the head, the groove being stepped from the cutout while extending thereto, and the retainer being pressed against the groove, wherein the turbine rotor disk comprises a head receiving hole formed on one side of the through-hole and having an inner diameter larger than the through-hole so that the head of the insertion pin is received in the head receiving hole, wherein the retainer is formed by bending a rectangular plate, and comprises:

a horizontal portion that is bent by plastic deformation;

a stepped portion connected from the horizontal portion in a stepped manner; and a vertical portion bent vertically from the stepped portion, wherein the head of the insertion pin is supported by a bent portion formed by bending a portion of the horizontal portion after the retainer is inserted into the through-hole of the mounting rib and the insertion pin is inserted into the through-hole, and wherein the bent portion is disposed inside the head receiving hole after bending and the retainer is not protruded from the outer surface of the mounting rib.

* * * * *